US008602589B2

(12) United States Patent
Sadeh et al.

(10) Patent No.: US 8,602,589 B2
(45) Date of Patent: Dec. 10, 2013

(54) LIGHTING DEVICE

(75) Inventors: Niv Sadeh, Ramot Hashavim (IL); Yaron Ronen, Jerusalem (IL)

(73) Assignee: D-Led Illumination Technologies Ltd., Hod Hasharon (IL)

( * ) Notice: Subject to any disclaimer, the term of this patent is extended or adjusted under 35 U.S.C. 154(b) by 314 days.

(21) Appl. No.: 12/945,905

(22) Filed: Nov. 15, 2010

(65) Prior Publication Data

US 2012/0120650 A1 May 17, 2012

(51) Int. Cl.
*F21V 3/02* (2006.01)

(52) U.S. Cl.
USPC ..... 362/235; 362/218; 362/221

(58) Field of Classification Search
USPC ..... 362/218, 221, 222, 217.02, 217.14, 362/349.02
See application file for complete search history.

(56) References Cited

U.S. PATENT DOCUMENTS 6,802,129 B1 * 10/2004 Wirth ..... 33/265
2008/0074667 A1 * 3/2008 Overbeck et al. ..... 356/402

* cited by examiner

*Primary Examiner* — David V Bruce
(74) *Attorney, Agent, or Firm* — Mark M. Friedman

(57) ABSTRACT

A lighting device is disclosed herein. The lighting device includes an optic holder designed to hold optic elements over a light emitting diode (LED). The optic holders design ensures that the LEDs dome is not damaged during the assembly of the lighting device. Open covers and closed covers are provided in order to allow or block light from the LEDs to come out of the lighting device or to block empty LED locations within the lighting device in order to provide an esthetic looking facade to the lighting device.

33 Claims, 12 Drawing Sheets

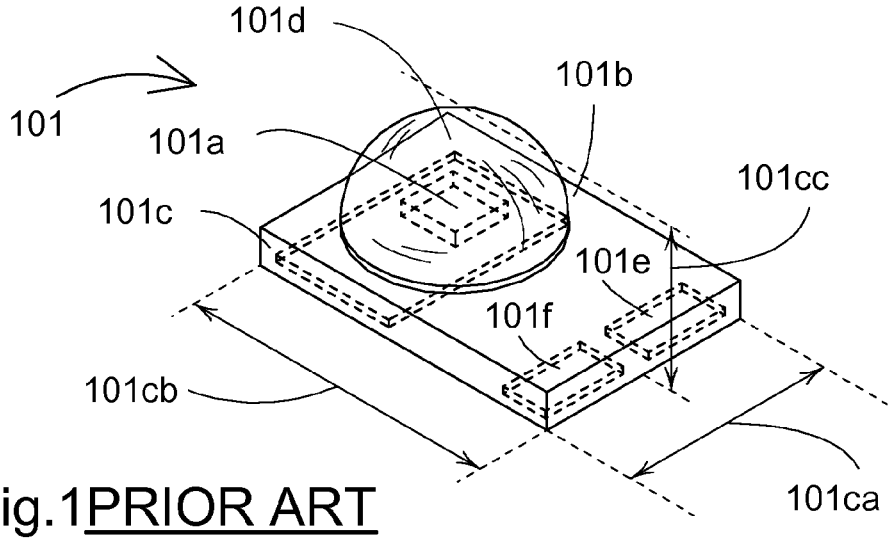
Fig.1PRIOR ART

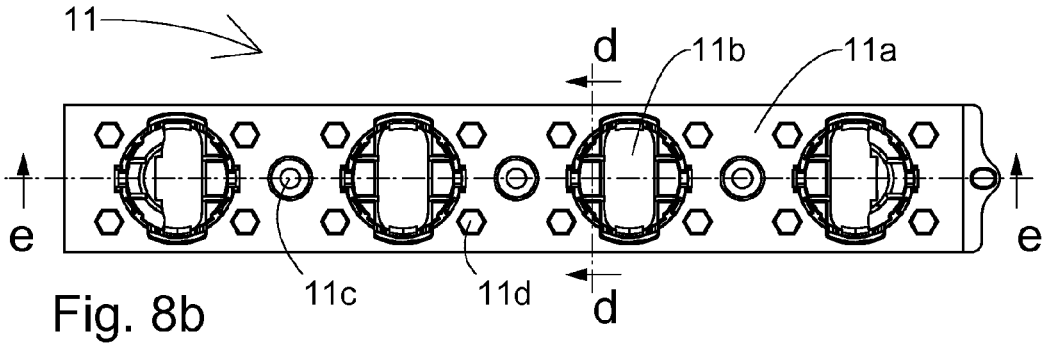
Fig. 8b
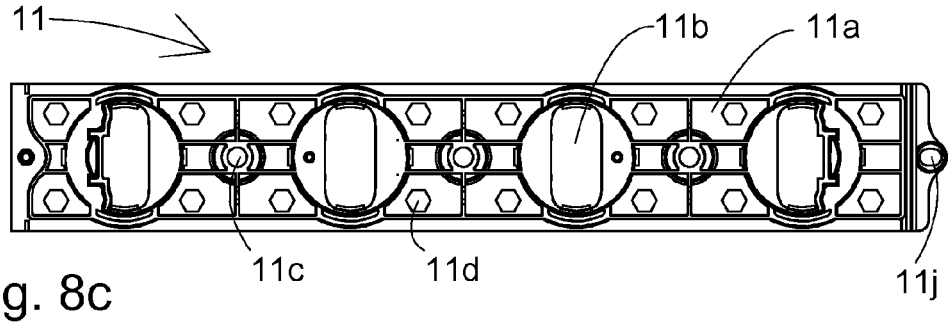
Fig. 8c
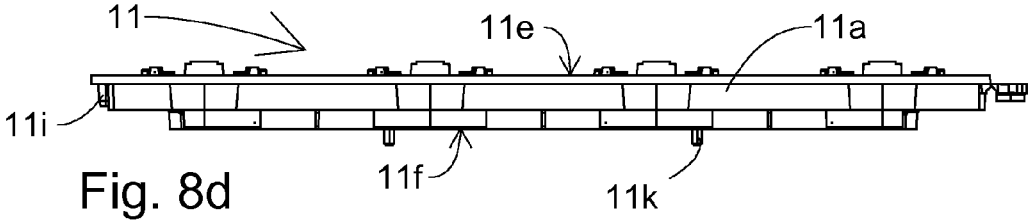
Fig. 8d
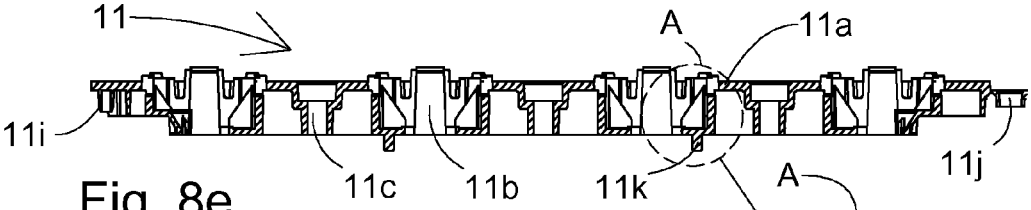
Fig. 8e
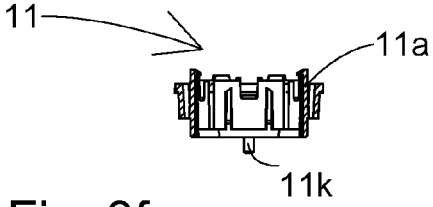
Fig. 8f
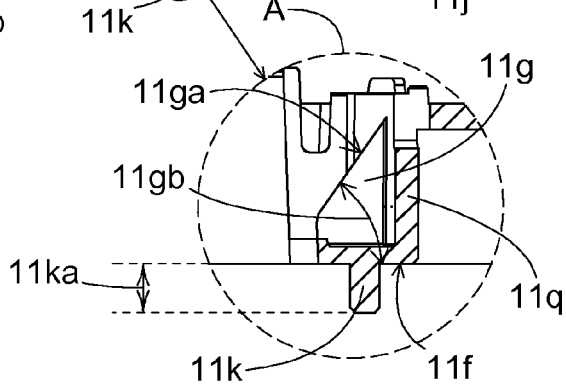

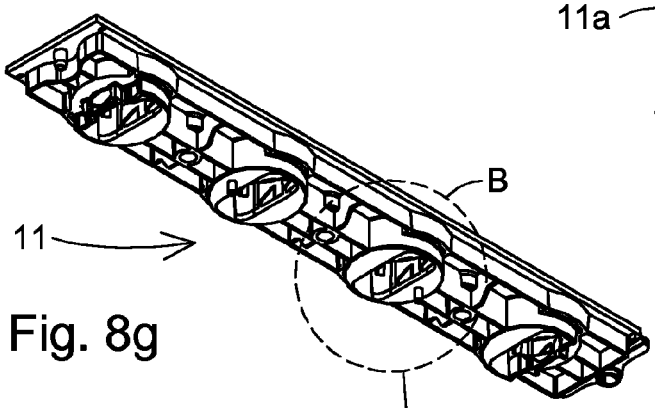
Fig. 8g
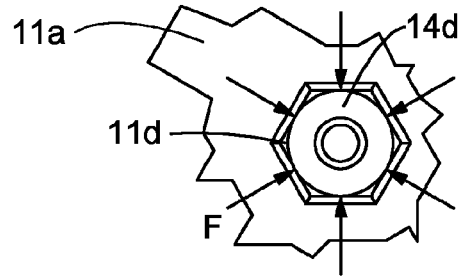
Fig. 8h
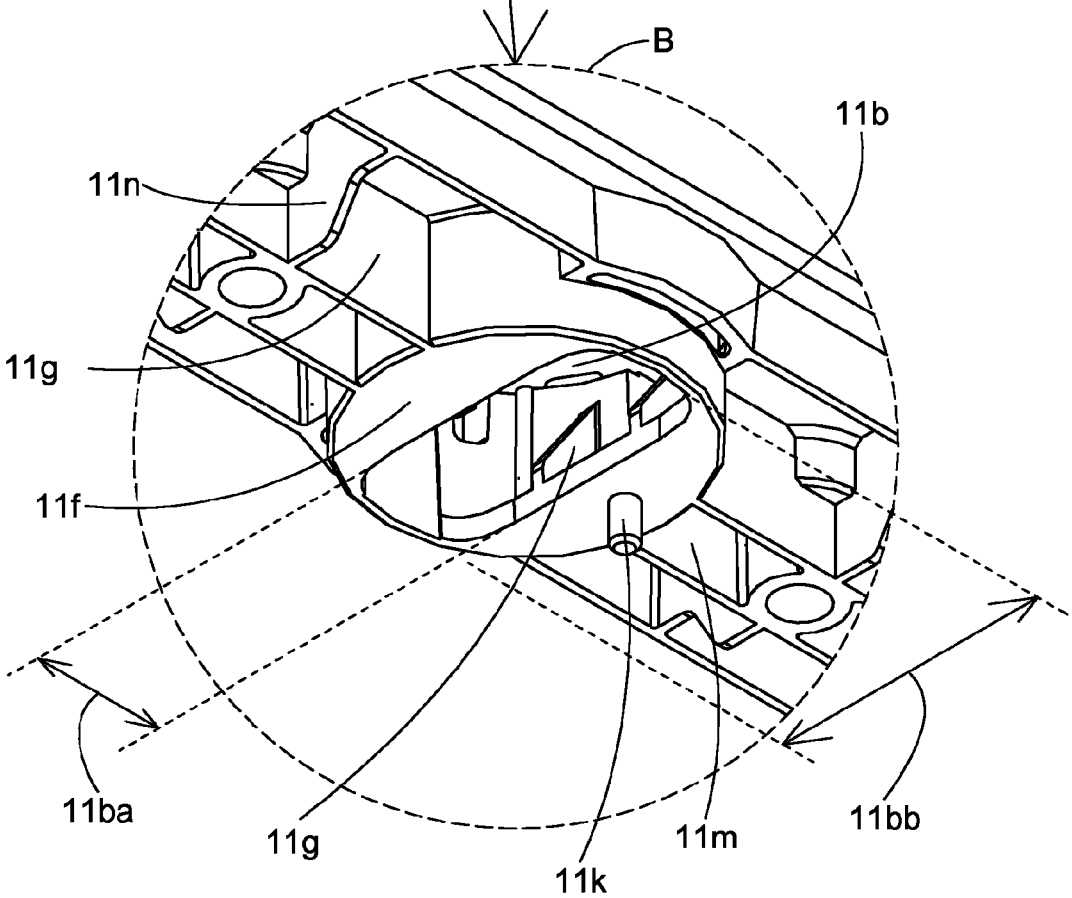

14a

LIGHTING DEVICE

FIELD OF THE INVENTION

The present invention relates to lighting devices, more particularly, to lighting devices including optic elements and optic elements holders.

BACKGROUND OF THE INVENTION

Electrical lighting devices have been used ever since the invention of the electrical light bulb by Thomas Edison in the $19^{th}$ century.

The era of semiconductors introduced a new lighting device known as a "light emitting diode" (LED) which can produce light using a very compact form factor. The latest LEDs are mounted onto printed circuit boards (PCBs) as surface mounted devices (SMDs) which do not require through holes to be drilled through the PCB.

FIG. 1 of the prior art is an isometric view of an SMD LED assembly 101. The LED assembly 101 includes an LED 101*a*, an LED package 101*b* and an LED dome 101*d*. The LED package 101*b* has an LED package side wall 101*c*, LED package longitudinal length 101*ca*, LED package lateral length 101*cb* and LED assembly height 101*cc*.

The SMD LED assembly 101 connects to the electrical circuit by means of an LED assembly cathode 101*e* and an LED assembly anode 101*f*.

FIG. 2*a* of the prior art is a bottom view schematic illustration of an optic element 13 used to disperse the light emitted by an LED 101*a*.

The light emitted by the LED 101*a* is placed within the optic element hole 13*a* and its light is evenly dispersed by the optic element 13. Should the optic element 13 or the LED dome 101*d* sustain damage (scratches, deformations, pressure, etc.), the light will not disperse evenly from the lighting device or the LED will be damaged.

Part of the optic element 13 can have a cone shape, with a circular cross section, and with an optic element cone angle 13*b*.

FIG. 2*b* of the prior art is a top view schematic illustration of an optic element 13 used to disperse the light emitted by the LED 101*a* upon which the section plane a-a is marked.

FIG. 2*c* of the prior art is a cross sectional view a-a of an optic element 13.

The present illustration depicts the optic element hole 13*a* into which the LED assembly 101 is inserted.

FIG. 3*a* of the prior art is an exploded schematic illustration of a prior art optic holder 90.

The prior art optic holder 90 is composed of a prior art optic holder body 91, an LED assembly 101 and an optic element 13.

FIG. 3*b* of the prior art is a top view schematic illustration of a prior art optic holder 90. The present illustration shows that the prior art optic holder body longitudinal length 91*a* and the prior art optic holder body lateral length 91*b* are smaller than the LED package longitudinal length 101*ca* and the LED package lateral length 101*cb*, respectively. This relation between these dimensions increases the risk that the prior art optic holder 90 would damage the LED dome 101*d* during the assembly process.

The current assembly process includes gluing the prior art optic holder 90 to the LED assembly 101 or to the printed circuit board (PBC) onto which it is assembled. The gluing of the prior art optic holder 90 is messy, time consuming and very inaccurate and placing it with even the slightest misalignment can cause damage to the LED assembly 101.

Offset position of the LED assembly in PCB can cause the optics to be rotated and change the position of the light beam, or malfunction of the lighting device.

There is therefore a need for a lighting device, which has characteristics and an assembly process that minimize the risk of damage to the LED assembly.

SUMMARY OF THE INVENTION

The background art does not teach or suggest a lighting device, which has characteristics and an assembly process that minimize the risk of damage to the LED assembly.

The present invention overcomes these deficiencies of the background art by providing a lighting device with a new optic holder.

An embodiment of the present invention is described herein below in which an optic holder which is equipped with several alignment pins, which are longer than the height of the LED assemblies used on the lighting device's printed circuit board (PCB) as well as an opening which is wider than the LED assemblies used on the lighting device's PCB.

The long alignment pins ensures that the optic holder is kept away from the LED assembly's dome until the optic holder is mounted onto the PCB and the wide openings in the optic holder ensure that once the optic holder is mounted onto the PCB there is enough room around the LED assemblies so that the optic holder does not touch the LED assemblies in order to minimize the risk of damaging the LED dome.

Under the PCB is a thermal pad which is used to dissipate part of the heat generated by the LEDs mounted on the PCB, as well as to provide electrical insulation.

The lighting device is also equipped with several open covers and several closed covers. The user of the lighting device may choose the configuration of the open and closed covers in the lighting device, allowing or disallowing light from the LEDs to come out through the covers.

Furthermore, the lighting device is encased in a housing which includes several mount tracks, which enable the user to mount the lighting device at various orientations and angles.

Additional objects and advantages of the invention will be set forth in part in the description which follows and, in part, will be obvious from the description, or may be learned by practice of the invention.

According to the present invention there is provided a lighting device including: (a) a main assembly including: (i) at least one optic holder, wherein each one of the at least one optic holder includes: (i.i) a holder body, having a holder upper surface and a holder bottom surface, wherein the bottom surface includes at least one holder opening; (i.ii) at least one holder space wall disposed between the holder upper surface and the holder bottom surface, wherein the holder space wall contains a holder space; (i.iii) at least one holder alignment pin disposed on the bottom surface, wherein the holder alignment pin has a predefined holder alignment pin length; (i.iv) at least one holder optic guide, disposed on each one of the holder space walls, inside each one of the at least one holder spaces; (i.v) at least one holder rib disposed on the holder upper surface; (i.vi) at least one holder longitudinal rib disposed on the holder upper surface, and at least one holder lateral rib disposed on the holder upper surface; (i.vii) at least one holder screw hole formed through each one of the holder upper surfaces; and (i.viii) at least one holder pin hole, formed through each one of the holder upper surfaces, wherein each one of the at least one holder openings has a predefined opening longitudinal length, and a predefined opening lateral length, wherein each one of the at least one holder optic guide has an holder optic guide end 11*ga*, wherein there is a predefined holder optic guide end angle between the holder optic guide end and the holder bottom surface; (ii) at least one printed circuit board, having a printed circuit board body, wherein the at least one printed circuit board, is securely connected to the at least optic holder, wherein each one of the at least one printed circuit board includes: (ii.i) at least one header connector securely connected to the printed circuit board body, wherein the at least one printed circuit board, has at least one printed circuit alignment pin hole formed through each one of the at least one printed circuit board body; (iii) at least one thermal pad having a thermal pad body wherein the at least one thermal pad is disposed on each one of the at least one printed circuit board; (iv) at least one open covers, having an open cover weight value, mounted on the at least one optic holder, the at least one open covers includes: (iv.i) an open cover body; (iv.ii) a cover opening formed through the open cover body; and (iv.iii) at least one open cover pin disposed on the open cover body, wherein the holder body applies force on all of the at least one open cover pins, of one of the at least one open covers; (v) at least one light emitted diode assembly having a light emitting diode assembly height, wherein the at least one light emitted diode assembly is securely connected to the at least one printed circuit board body, and wherein the at least one light emitted diode assembly includes: (v.i) a light emitted diode package having a light emitted diode package longitudinal length, and a light emitted diode package lateral length; (v.ii) a light emitted diode securely connected to the light emitted diode package; and (v.iii) a light emitted diode dome light emitted diode package, wherein each one of the holder openings has a predefined opening longitudinal length, and a predefined opening lateral length, wherein the predefined opening longitudinal length is substantially larger than the light emitted diode package longitudinal length and wherein the predefined opening lateral length is substantially larger than the light emitted diode package lateral length, wherein the at least one holder alignment pin length is substantially larger than the at least one of the light emitting diode package height; (vii) at least one optic element, mounted inside of each one of the at least one holder opening, wherein the at least one optic element has an optic element hole, and wherein the at least one optic element has an optic element cone angle, wherein the optic element cone angle is compatible with the holder optic guide end angle; and (viii) at least one main assembly screw mounted through one of the at least one holder screw hole.

According to the present invention there is provided the lighting device further including: (b) a housing, wherein the main assembly is located inside the housing, and wherein the housing includes: (i) a housing body; (ii) an exterior cover mounted on the housing, wherein the exterior cover is at least partially transparent to light; and (iii) at least one screws holder mounted inside the housing, wherein the at least one main assembly screw is screwed into the at least one screws holder.

BRIEF DESCRIPTION OF THE DRAWINGS

The invention is herein described, by way of example only, with reference to the accompanying drawings, wherein:

FIG. 1 of the prior art is an isometric view of an SMD LED assembly.

FIG. 8*b* is a top view schematic illustration of an optic holder upon which section planes d-d and e-e are marked, according to the present invention.

FIG. 8*c* is a bottom view schematic illustration of an optic holder, according to the present invention.

FIG. 8*d* is a side view schematic illustration of an optic holder, according to the present invention.

FIG. 8*e* is a cross sectional view e-e of an optic holder, according to the present invention. The illustration marks detail A in a circle, which is magnified in the circle on the bottom side of the illustration.

FIG. 8*f* is a cross sectional view d-d of an optic holder, according to the present invention.

FIG. 8*g* is a bottom side isometric schematic illustration of an optic holder, according to the present invention. The illustration marks detail B in a circle, which is magnified in the circle on the bottom side of the illustration.

FIG. 8*h* is a bottom view schematic illustration of an open cover pin, mounted inside a holder pin hole, according to the present invention.

DETAILED DESCRIPTION OF EMBODIMENTS

Figure 2A:
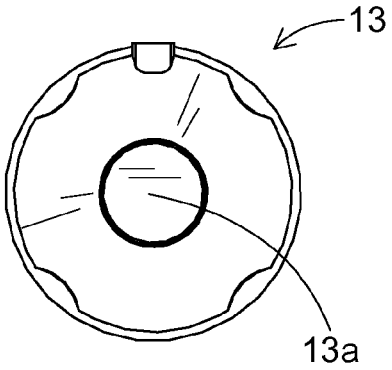
Fig.2a PRIOR ART
FIG. 2*a* of the prior art is a bottom view schematic illustration of an optic element used to disperse the light emitted by an LED.
Figure 2B:
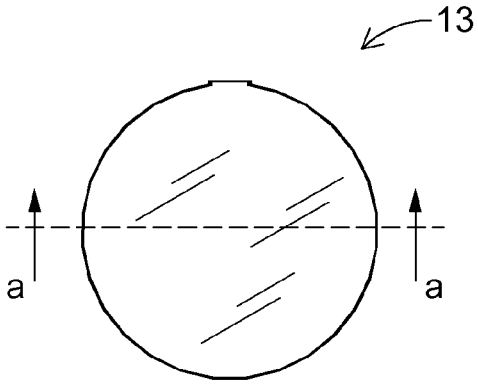
Fig. 2b PRIOR ART
FIG. 2*b* of the prior art is a top view schematic illustration of an optic element used to disperse the light emitted by the LED upon which the section plane a-a is marked.
Figure 2C:
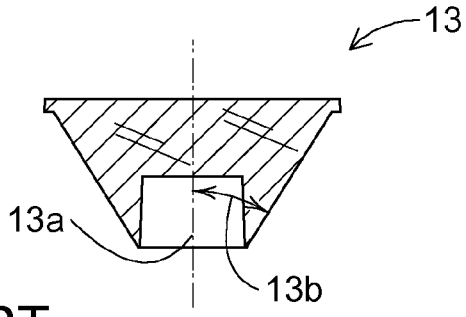
Fig. 2c PRIOR ART
FIG. 2*c* of the prior art is a cross sectional view a-a of an optic element. The present illustration depicts the optic element hole into which the LED assembly is inserted.
Figure 3A:
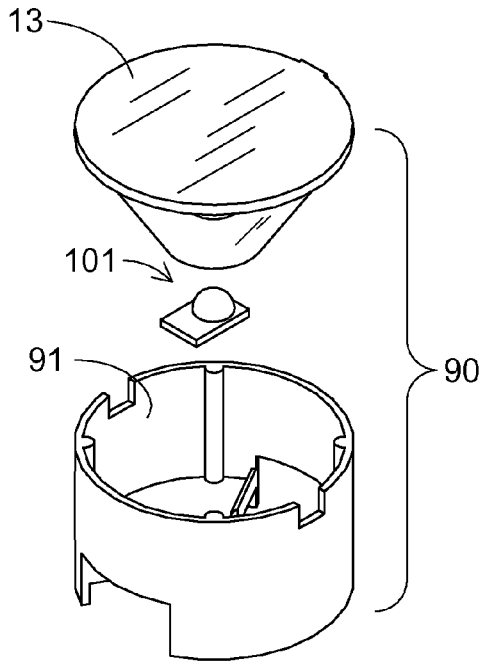
Fig. 3a PRIOR ART
FIG. 3*a* of the prior art is an exploded schematic illustration of a prior art optic holder.
Figure 3B:
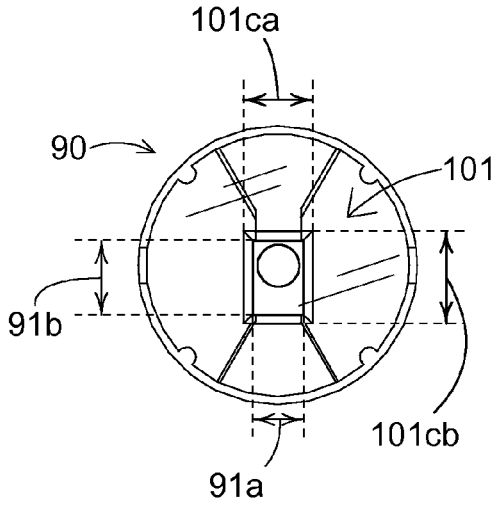
Fig. 3b PRIOR ART
FIG. 3*b* of the prior art is a top view schematic illustration of a prior art optic holder.

The present invention is of a lighting device.

The principles and operation of a lighting device according to the present invention may be better understood with reference to the drawings and the accompanying description.

Before explaining at least one embodiment of the invention in detail, it is to be understood that the invention is not limited in its application to the details of construction and the arrangement of the components set forth in the following description or illustrated in the drawings.

Unless otherwise defined, all technical and scientific terms used herein have the same meaning as commonly understood by one of ordinary skill in the art to which this invention belongs. The materials, dimensions, methods, and examples provided herein are illustrative only and are not intended to be limiting.

Figure 4:
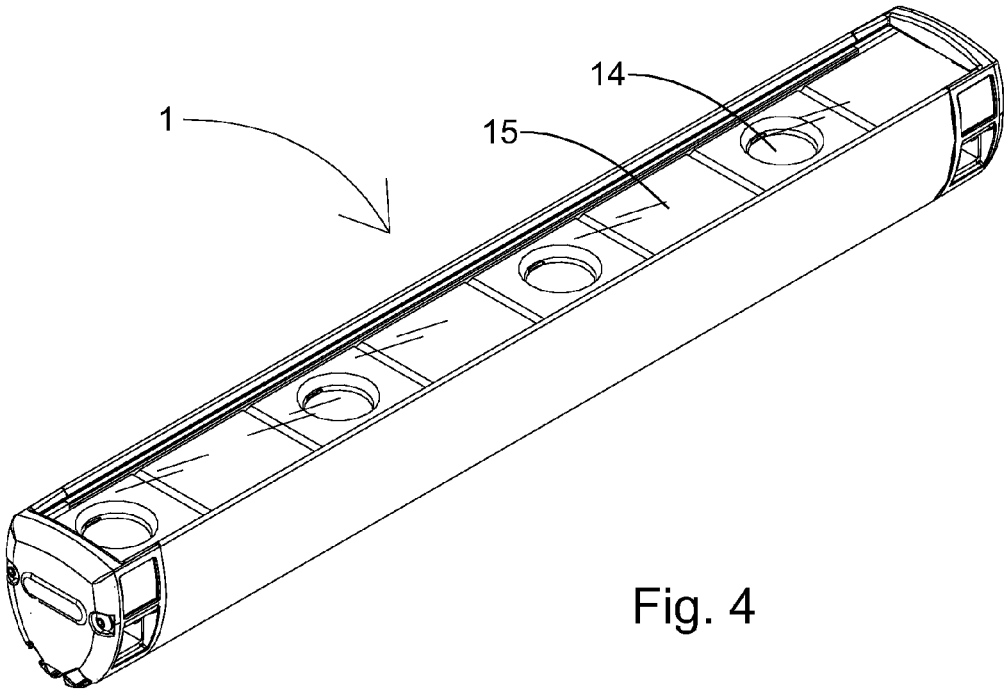
FIG. 4 is an isometric schematic illustration of a lighting device, according to the present invention.

The following list is a legend of the numbering of the application illustrations:

1 lighting device
10 main assembly
11 optic holder
11*a* holder body
11*b* holder opening
11*ba* opening longitudinal length
11*bb* opening lateral length
11*c* holder screw hole
11*d* holder pin hole
11*e* holder upper surface
11*f* holder bottom surface
11*g* holder optic guide
11*ga* holder optic guide end
11*gb* holder optic guide end angle
11*i* holder end pin
11*j* holder end hole
11*ie* holder first end
11*je* holder second end
11*k* holder alignment pin
11*ka* holder alignment pin length
11*m* holder longitudinal rib
11*n* holder lateral rib
11*p* holder space
11*q* holder space wall
13 optic element
13*a* optic element hole
13*b* optic element cone angle
14 open cover
14*a* open cover body
14*b* cover opening
14*d* open cover pin
14*e* open cover leg
14*w* open cover weight
15 closed cover
15*a* closed cover body
15*b* cover longitudinal side wall
15*c* cover lateral side wall
15*d* closed cover pin
15*e* closed cover leg
15*w* closed cover weight
16 printed circuit board (PCB)
16*a* circuit board body
16*b* header connector
16*c* circuit boards connector
16*d* printed circuit board screw hole
16*e* printed circuit alignment pin hole
17 thermal pad
17*a* thermal pad body
17*b* thermal pad screw hole
18 main assembly screws
20 housing
21 housing body
21*a* exterior cover track
21*b* end cup screws track
21*c* screws holder track
21*d* tunnel
21*e* mount track
21*f* carrier
21*g* carrier side wall
22 exterior cover
23 input end cup
23*a* end cup front wall
23*b* end cup side wall
23*c* end cup screw hole
23*d* end cup opening
23*e* end cup partition
23*f* end cup pin
24 output end cup
25 end cup screws
26 screws holder
26*a* screws holder base rib
26*b* screws holder perpendicular rib
26*c* screws holder internal thread
90 prior art optic holder
91 prior art optic holder body
91*a* prior art optic holder body longitudinal length
91*b* prior art optic holder body lateral length
101 LED assembly
101*a* LED
101*b* LED package
101*c* LED package side wall
101*ca* LED package longitudinal length
101*cb* LED package lateral length
101*d* LED dome
101*cc* LED assembly height
101*e* LED assembly cathode
101*f* LED assembly anode
F force Referring now to the drawings, FIG. 4 is an isometric schematic illustration of a lighting device 1, according to the present invention.

The lighting device 1 described in the present illustration contains four open covers 14 and four closed covers 15.

The present invention allows for various combinations of open covers 14 and closed covers 15, according to user requirements, and is not limited in any way to eight covers.

Figure 5:
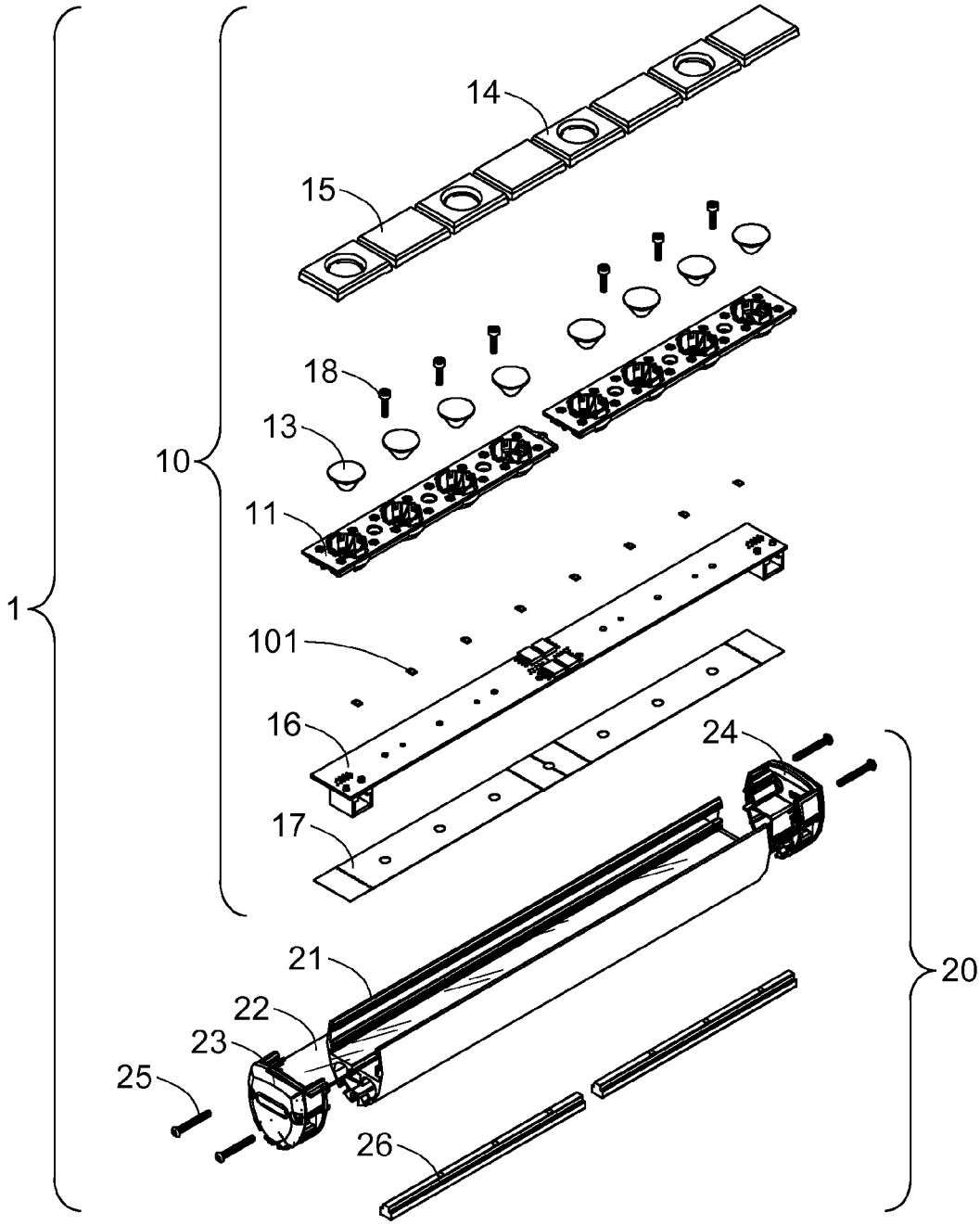
FIG. 5 is an exploded schematic illustration of a lighting device, according to the present invention.

FIG. 5 is an exploded schematic illustration of one embodiment of a lighting device 1, according to the present invention.

The present illustration shows the two main assemblies in the lighting device 1: the main assembly 10 and the housing 20.

The main assembly 10 contains several open covers 14 and closed covers 15, thermal pads 17, printed circuit boards 16, optic holder 11, optic elements 13 and several main assembly screws 18, which hold the main assembly's 10 components together.

The present invention is not limited in any way to two elements as shown in the specific case of the present illustration, such as the example of two optic holders 11, two thermal pads 17, and two printed circuit boards 16.

According to the present invention, the main assembly 10 can include, for example one optic holder 11 or more than one optic holder 11. Likewise for other elements mentioned here.

According to the present invention, the main assembly 10 includes at least one LED assembly 101, with the present illustration showing eight.

The housing 20 contains a housing body 21, an exterior cover 22, an input end cup 23, an output end cup 24, screws holders 26 and several end cup screws 25 which hold the housing's 20 components together.

Figure 6A:
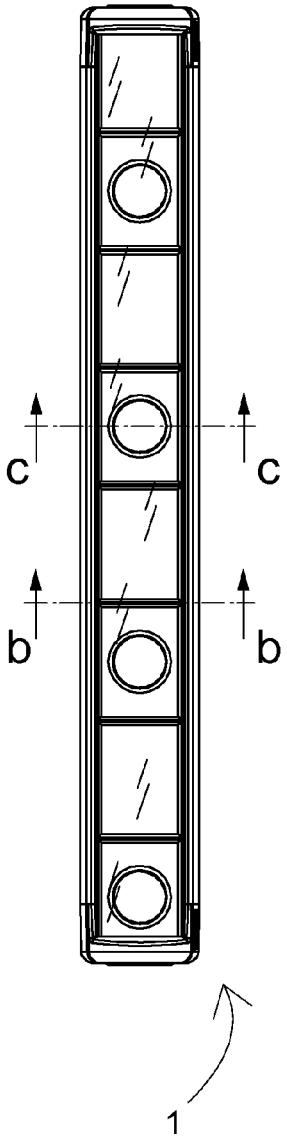
FIG. 6*a* is a top view schematic illustration of a lighting device upon which section planes b-b and c-c are marked, according to the present invention.

FIG. 6*a* is a top view schematic illustration of a lighting device 1 upon which the section plane b-b and c-c are marked, according to the present invention.

Figure 6B:
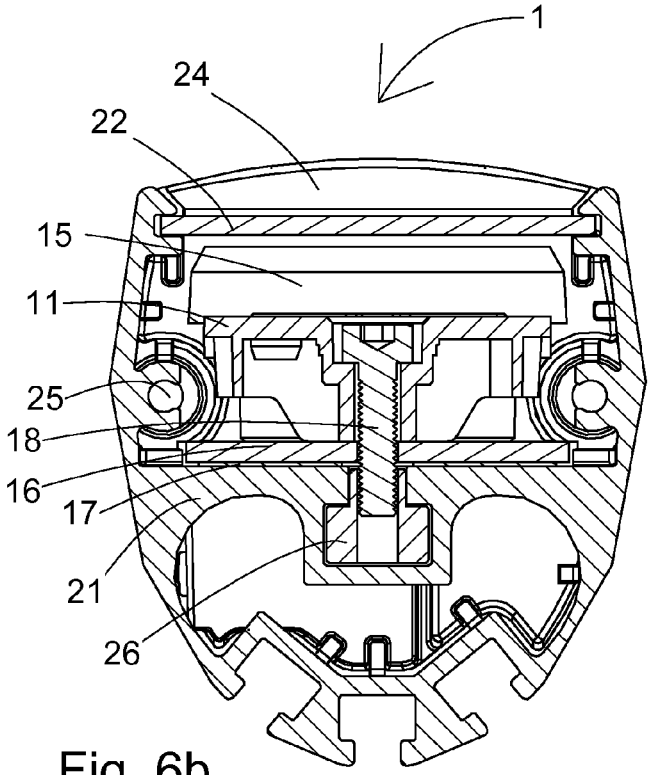
FIG. 6*b* is a cross sectional view b-b of a lighting device, according to the present invention.

FIG. 6*b* is a cross sectional view b-b of a lighting device 1, according to the present invention.

The present illustration shows the section plane b-b, which crosses the lighting device 1 at the location of a main assembly screw 18. The main assembly screw 18 is held in place by the screws holder 26, which has corresponding screw threading to accommodate the main assembly screws 18. The main assembly screws 18 go through and optic holder 11, the printed circuit board 16 and the thermal pad 17, and holds them together.

Above the optic holder 11 is a closed cover 15 which is used to block the light emitted by the LED 101*a* (not shown in the present illustration) located under the closed cover 15, or to cover a place without any installed LED assembly 101 and optic element 13, (both not shown in the present illustration).

In order to allow the light emitted by the LED 101*a* (not shown in the present illustration) to come out of the lighting device 1, an open cover 14 may be used. Each LED 101*a* location may have either an open cover 14 or a closed cover 15, according to the users' needs.

The lighting device 1 is closed by an exterior cover 22, which is transparent to allow light through it yet to provide mechanical protection to the main assembly's 10 components of the lighting device 1.

The main assembly 10 is held within the housing body 21, which is closed from the sides with the input end cup 23 and the output end cup 24 (both not shown in the present illustration), which are held in place by the end cup screws 25.

Figure 6C:
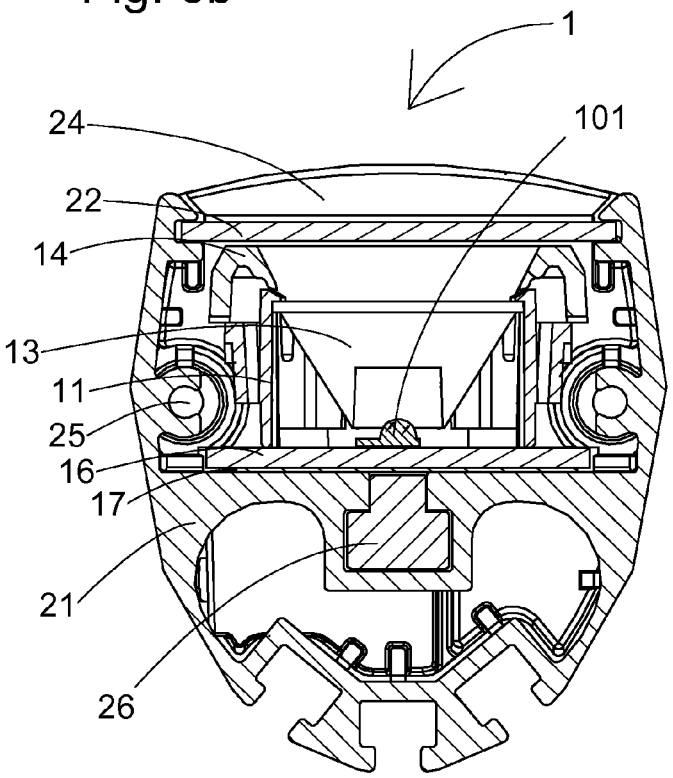
FIG. 6*c* is a cross sectional view c-c of a lighting device, according to the present invention.

FIG. 6*c* is a cross sectional view c-c of a lighting device 1, according to the present invention.

The present illustration shows the section plane c-c, which crosses the lighting device 1 at the location of an LED assembly 101. Above the LED assembly 101 is an optic element 13 and an open cover 14.

Figure 7:
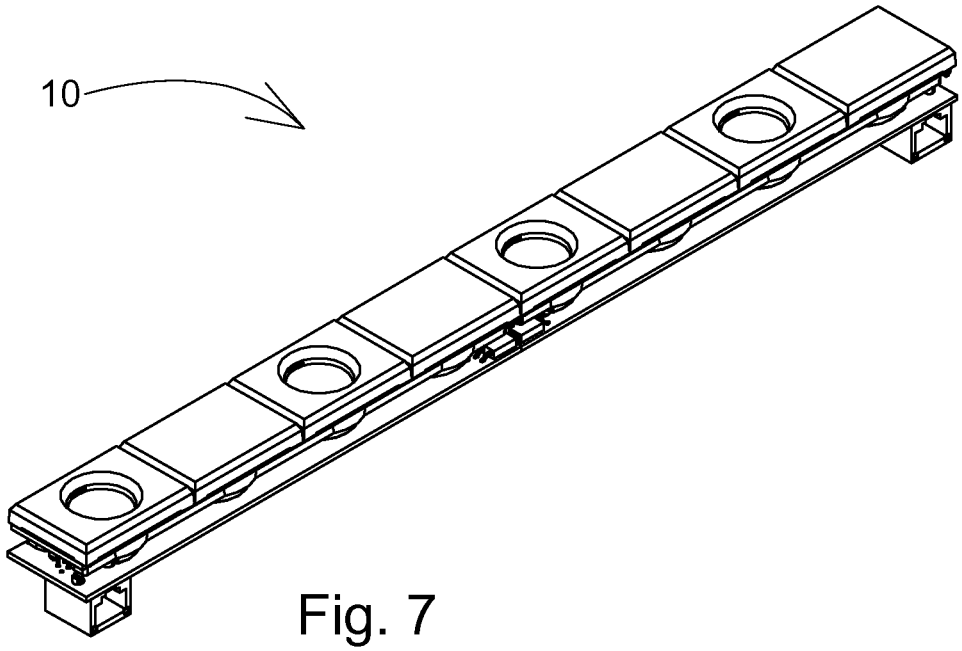
FIG. 7 is an isometric schematic illustration of a main assembly, according to the present invention.

FIG. 7 is an isometric schematic illustration of a main assembly 10, according to the present invention.

The present figure shows the assembled view of the main assembly 10.

Figure 8A:
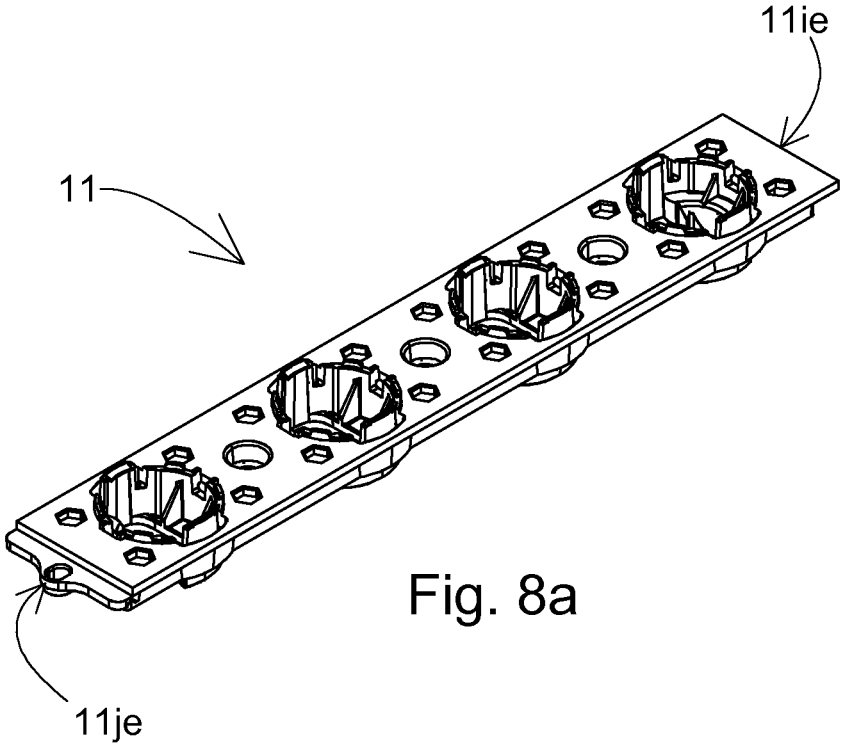
FIG. 8*a* is an isometric schematic illustration of an optic holder, according to the present invention.

FIG. 8*a* is an isometric schematic illustration of an optic holder 11, according to the present invention.

The structure of the optic holder 11 ensures that the LED assembly 101 will not be damaged during the assembly of the lighting device 1. Further details are given in the following figures.

The embodiment of the optic holder 11 of the present figure depicts four openings for optic elements 13, but other configurations may be possible such as one, two, three or more openings in each optic holder.

Each optic holder 11 includes a holder first end 11*ie* and a holder second end 11*je*.

FIG. 8*b* is a top view schematic illustration of an optic holder 11 upon which the section plane d-d and e-e are marked, according to the present invention.

The optic holder's 11 main part is the holder body 11*a* in which there are several holder openings 11*b*. Between every two holder openings 11*b*, there is a holder screw hole 11*e* and around each holder openings 11*b* there are four holder pin holes 11*d*. A different number of holder pin holes 11*d* can be used.

FIG. 8*c* is a bottom view schematic illustration of an optic holder 11, according to the present invention.

The bottom side of the optic holder 11 is equipped with a holder end pin 11*i* (not shown in the present illustration), and a holder end hole 11*j*. In order to attach two optic holders 11, the holder end pin 11*i* of one optic holder 11 is inserted into the holder end hole 11*j* of another optic holder 11.

FIG. 8*d* is a side view schematic illustration of an optic holder 11, according to the present invention.

The present illustration shows the holder upper surface 11*e*, the holder bottom surface 11*f* and two holder alignment pins 11*k* (other embodiments may have more or less than two holder alignment pins 11*k*).

FIG. 8*e* is a cross sectional view e-e of an optic holder 11, according to the present invention. The illustration marks detail A in a circle, which is magnified in the circle on the bottom side of the illustration.

Detail A illustrates the structure of the holder optic guide 11*g* used to house an optic element 13, (not shown in the present illustration), in the optic holder 11. The holder optic guide 11*g* has a holder optic guide end 11*ga*. The angle between the holder optic guide end 11*ga* and the holder bottom surface 11*f* is the holder optic guide end angle 11*gb* and is designed to fit an optic element 13, which also helps to prevent the infliction of scratches upon LED dome 101*d* during production of the main assembly 10, (not shown in the present illustration).

In addition, detail A illustrates a holder alignment pin 11*k* and its length: holder alignment pin length 11*ka*. The holder alignment pin length 11*ka* is set so that it is greater than LED assembly height 101 cc, (not shown in the present illustration, shown in FIG. 1) in order to ensure that unless the holder alignment pin 11*k* is inserted into the printed circuit board alignment pin hole 16*e* (not shown in the present illustration, shown in FIG. 10), the holder bottom surface 11*f* is higher than the top of the LED dome 101*d* and there cannot be any contact between them leading to damage to the LED dome 101*d*.

FIG. 8*f* is a cross sectional view d-d of an optic holder 11, according to the present invention.

In the present illustration, it is possible to see the holder body 11*a* and the holder alignment pin 11*k* which is located near the holder opening 11*b*.

FIG. 8*g* is a bottom side isometric view schematic illustration of an optic holder 11, according to the present invention.

The illustration marks detail B in a circle, which is magnified in the circle on the bottom side of the illustration. Detail B depicts the smaller details surrounding the holder opening 11*b* such as the holder lateral ribs 11*n* and holder longitudinal ribs 11*m* which are used to enhance the structural integrity of the optic holder 11.

Other embodiments may use solid blocks of material rather than thin ribs for this purpose and the ribs themselves may have other shapes than the ones shown in the present illustration. The ribs may be longitudinal, lateral, diagonal, curved, etc. and the description brought here is not meant to limit the present invention.

Two important dimensions illustrated in detail B are the opening longitudinal length 11*ba* and the opening lateral length 11*bb* which are designed to be substantially larger than the LED package longitudinal length 101*ca* and the LED package lateral length 101*cb* so that once the optic holder 11 is mounted onto the printed circuit board 16, there is sufficient distance between the optic holder 11 and the LED assembly 101.

FIG. 8*h* is a bottom view schematic illustration of an open cover pin 14*d*, mounted inside a holder pin hole 11*d*, according to the present invention.

The present illustration shows a small segment of a holder body 11*a*, around the holder pin hole 11*d*.

The holder body 11*a* applies force F on the open cover pin 14*d*. The strength of force F is sufficient to enable manual assembly, without use of any tools, of open cover 14, (not shown in the present illustration, shown in FIG. 9*d*), or closed cover 15 (not shown in the present illustration, shown in FIG. 9*b*) and ensures their good attachment for all practical purposes to the optic holder 11, (not shown in the present illustration, shown in FIG. 8*g*). The sum of force F applied to each one of the open cover pins 14*d* of each one of the open covers 14 (not shown in the present illustration, shown in FIG. 9*c*) is no smaller than twice the value of the open cover weight 14*w* and no larger than eight times the value of the open cover weight 14*w*.

Figure 9A:
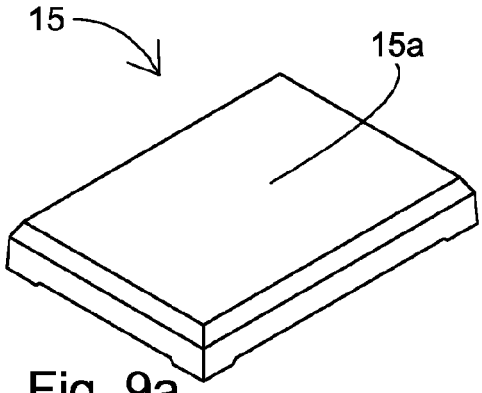
FIG. 9*a* is a top view isometric schematic illustration of a closed cover, according to the present invention.
Figure 9B:
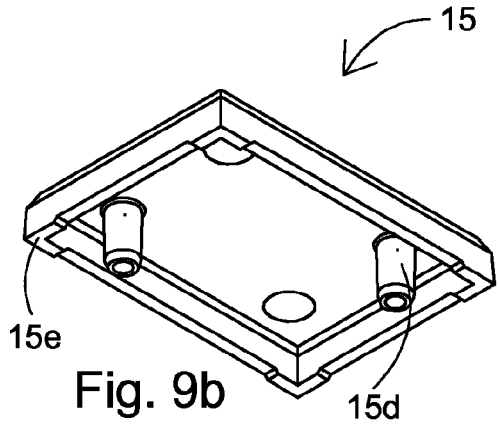
FIG. 9*b* is a bottom view isometric schematic illustration of a closed cover, according to the present invention.
Figure 9C:
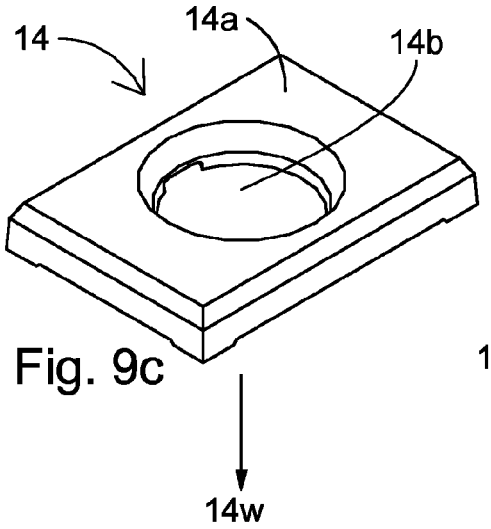
FIG. 9*c* is a top view isometric schematic illustration of an open cover, according to the present invention.
Figure 9D:
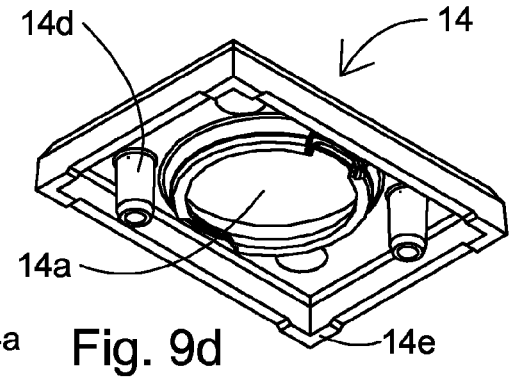
FIG. 9*d* is a bottom view isometric schematic illustration of an open cover, according to the present invention.

This also applies to the force F applied to the closed cover pins 15*d*, (not shown in the present illustration, shown in FIG. 9*d*).

FIG. 9*a* is a top view isometric schematic illustration of a closed cover 15, according to the present invention.

The closed cover 15 has a closed cover body 15*a* which is solid and does not allow any light to pass through it.

An additional option according to the present invention is using a closed cover 15, which enables filtering light.

LED assembly 101 and optic element 13 (both not shown in the present illustration).

FIG. 9*b* is a bottom view isometric schematic illustration of a closed cover 15, according to the present invention.

On the bottom side of the closed cover 15 are two (or more) closed cover pins 15*d*. The closed cover pins 15*d* are inserted into the holder pin hole 11*d* (not shown in the present illustration, shown in FIG. 8*b*) and its size is so that the friction between the closed cover pins 15*d* and the walls of the holder pin hole 11*d* hold the closed cover 15 in its place.

In addition, there are closed cover legs 15*e* which are used to elevate the closed cover 15 from the optic holder 11 (not shown in the present illustration, shown in FIG. 8*a*).

FIG. 9*c* is a top view isometric schematic illustration of an open cover 14, according to the present invention.

The open cover 14 has an open cover body 14*a*, which includes a cover opening 14*b*. The cover opening 14*b* is used to enable light to pass through the open cover 14.

The open cover 14 has an open cover weight 14*w*.

FIG. 9*d* is a bottom view isometric schematic illustration of an open cover 14, according to the present invention.

Just like the closed cover 15, the bottom side of the open cover 14 includes two (or more) open cover pins 14*d*. The open cover pins 14*d* are inserted into the holder pin hole 11*d* (not shown in the present illustration, shown in FIG. 8*b*) and its size is so that the friction between the open cover pins 14*d* and the walls of the holder pin hole 11*d* hold the open cover 14 in its place.

In addition, there are open cover legs 14*e*, which are used to elevate the open cover 14 from the optic holder 11 (not shown in the present illustration, shown in FIG. 8*a*).

Figure 9E:
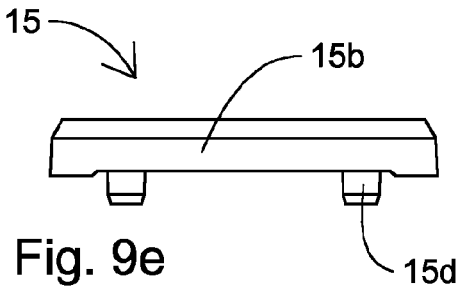
FIG. 9*e* is a right side view schematic illustration of a closed cover, according to the present invention.

FIG. 9*e* is a right side view schematic illustration of a closed cover 15, according to the present invention.

The right side view of the closed cover 15 shows the cover longitudinal side wall 15*b*.

This view also presents open cover 14.

Figure 9F:
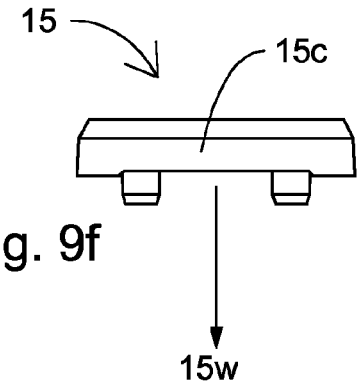
FIG. 9*f* is a left side view schematic illustration of a closed cover, according to the present invention.

FIG. 9*f* is a left side view schematic illustration of a closed cover 15, according to the present invention.

The left side view of the closed cover 15 shows the cover lateral side wall 15*c*.

This view also presents open cover 14.

The closed cover 15 has a closed cover weight 15*w*.

Figure 10:
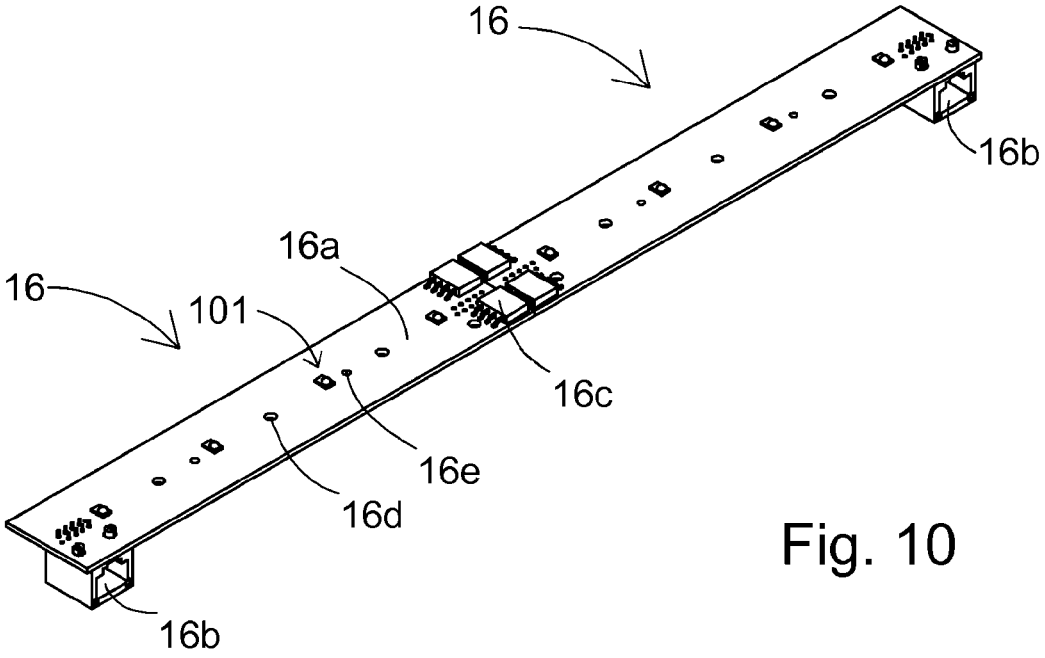
FIG. 10 is an isometric schematic illustration of two printed circuit boards connected to each other, according to the present invention.

FIG. 10 is an isometric schematic illustration of two printed circuit boards 16 connected to each other, according to the present invention.

The circuit board 16 has a circuit board body 16*a*. In order to use modular components it is preferred to have short printed circuit boards 16 which normally consist of three or four LED assemblies 101. When longer lighting devices 1 are needed it is possible to connect several circuit boards 16 in series using several circuit boards connectors 16*c*. The present illustration depicts two printed circuit boards 16 connected to each other using four circuit boards connectors 16*c*.

The header connectors 16*b* are used to connect the lighting device 1 to an external control unit.

Each printed circuit board 16 is equipped with several printed circuit board screw holes 16*d* and several printed circuit board alignment pin hole 16*e*. According to the number of LED assemblies 101 mounted on the printed circuit boards 16.

Figure 11:
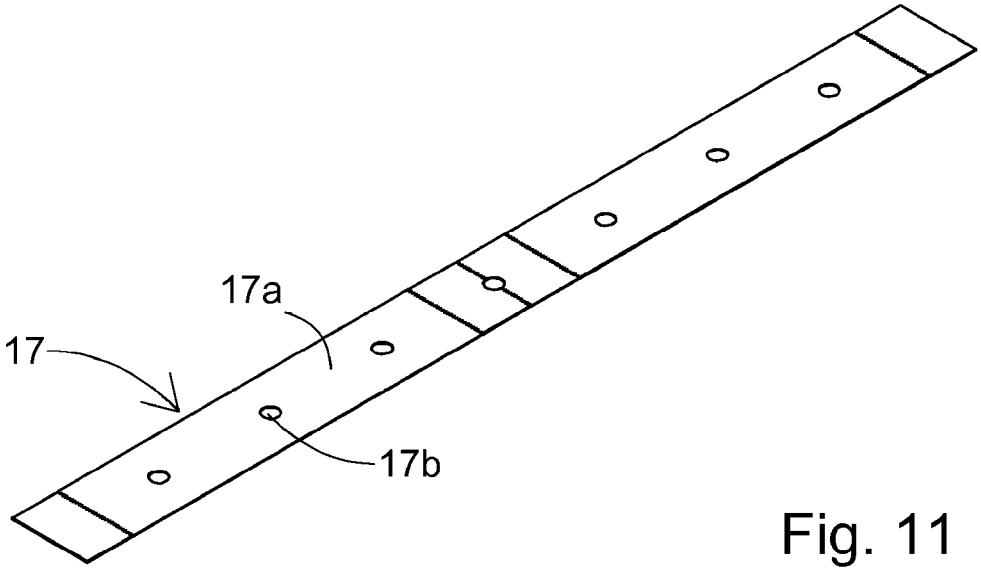
FIG. 11 is an isometric schematic illustration of two thermal pads connected to each other, according to the present invention.

FIG. 11 is an isometric schematic illustration of two thermal pads 17 connected to each other, according to the present invention.

The thermal pad 17 is designed so that its size corresponds to the size of the printed circuit board 16 as the thermal pad 17 is assembled directly under the printed circuit board 16. The thermal pad 17 has a thermal pad body 17*a* and several thermal pad screw holes 17*b* according to the number of printed circuit board screw holes 16*d* (not shown in the present illustration, shown in FIG. 10).

In addition, the thermal pad 17 is used to electrically isolate the printed circuit board 16, (not shown in the present figure, shown in FIG. 13), from the housing body 21, (not shown in the present figure, shown in FIG. 10), as well as to apply constant pressure on the main assembly screws 18 (not shown in the present figure, shown in FIG. 6*b*).

Figure 12:
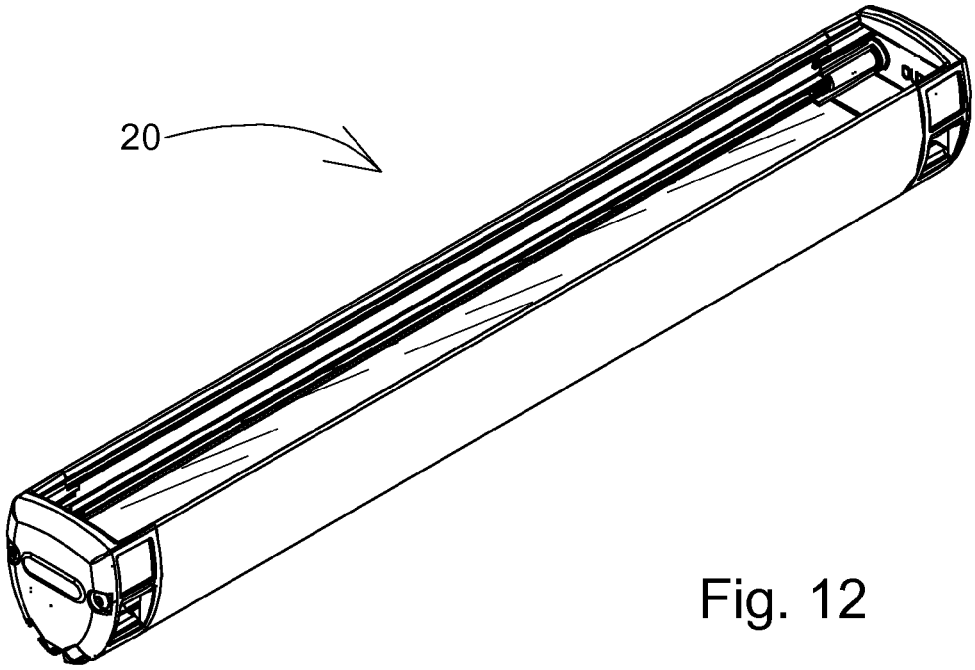
FIG. 12 is an isometric schematic illustration of housing, according to the present illustration.

FIG. 12 is an isometric schematic illustration of a housing 20, according to the present illustration.

The present illustration shows an assembled housing 20, absent the main assembly 10.

Figure 13:
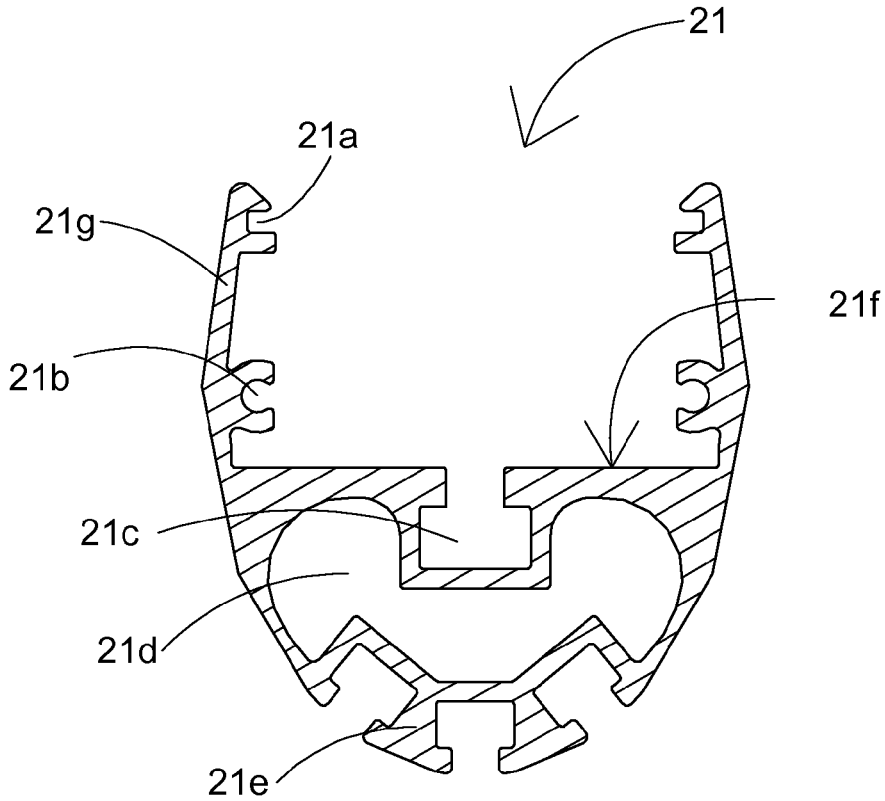
FIG. 13 is a transverse cross sectional view of a housing body, according to the present illustration.

FIG. 13 is a transverse cross sectional view of a housing body 21, according to the present illustration.

The major components of the housing body 21 are the exterior cover track 21*a*, end cup screws track 21*b*, screws holder track 21*c*, tunnel 21*d*, mount track 21*e* and carrier 21*f*.

Mount track 21*e* also serves as a cooling rib and for the purpose of attachment to infrastructure.

Figure 14A:
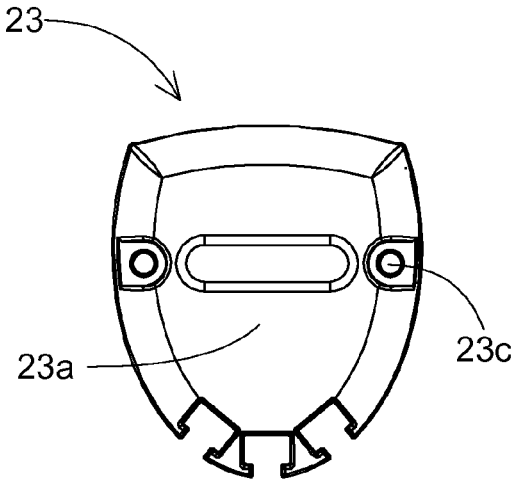
FIG. 14*a* is a front view schematic illustration of an input end cup, according to the present illustration.

FIG. 14*a* is a front view schematic illustration of an input end cup 23, according to the present illustration.

The input end cup 23 has an end cup front wall 23*a* on which the "INPUT" designation may be noted for ease of use.

Figure 14B:
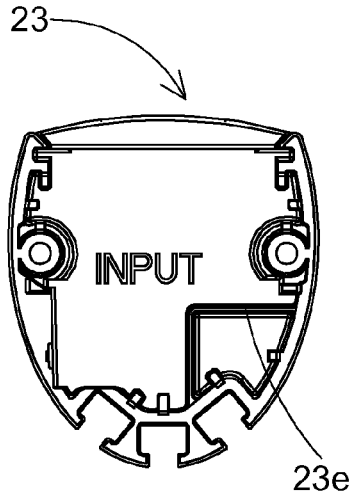
FIG. 14*b* is a back view schematic illustration of an input end cup, according to the present illustration.

FIG. 14*b* is a back view schematic illustration of an input end cup 23, according to the present illustration.

On the back side of the input end cup 23 is the end cup partition 23*e*.

Figure 14C:
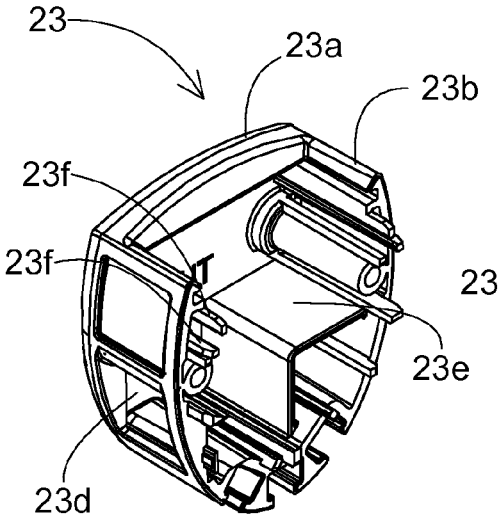
FIG. 14*c* is a back view isometric schematic illustration of an input end cup, according to the present illustration.

FIG. 14*c* is a back view isometric schematic illustration of an input end cup 23, according to the present illustration.

Depicted in the present illustration are the end cup front wall 23*a*, end cup side wall 23*b*, end cup opening 23*d*, end cup partition 23*e*, and end cup pins 23*f*.

Figure 14D:
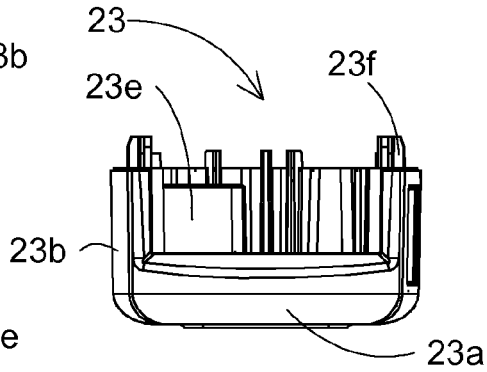
FIG. 14*d* is a top view schematic illustration of an input end cup, according to the present illustration.

FIG. 14*d* is a top view schematic illustration of an input end cup 23, according to the present illustration.

The top view of the input end cup 23 shows the end cup front wall 23*a*, end cup side wall 23*b*, end cup partition 23*e* and end cup pins 23*f*.

Figure 15:
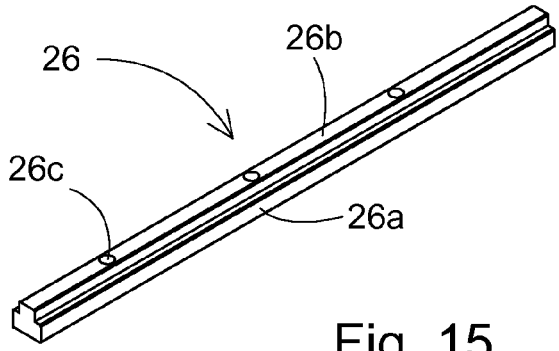
FIG. 15 is an isometric schematic illustration of a screws holder, according to the present illustration.

FIG. 15 is an isometric schematic illustration of a screws holder 26, according to the present illustration.

The screws holder 26 includes a screws holder base rib 26*a* which serves as the basis of the screws holder 26. The top part of the screws holder 26 is the screws holder perpendicular rib 26*b* into which several screws holder internal thread 26*c* are formed. The number of screws holder internal thread 26*c* is the same as the number of main assembly screws 18 (not shown in the present illustration, shown in FIG. 5) that are used in the assembly of the lighting device 1.

Figure 16:
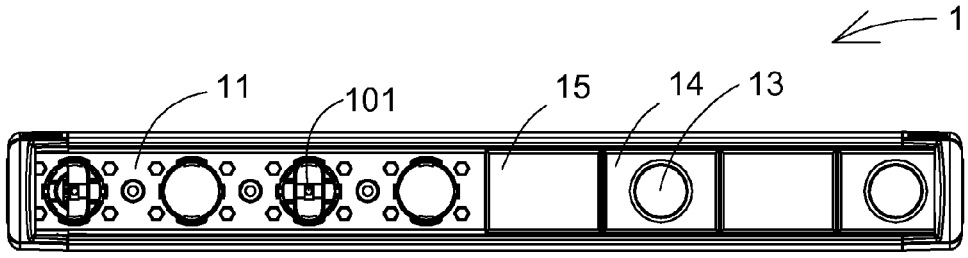
FIG. 16 is a top view schematic illustration of a lighting device, according to the present invention.

FIG. 16 is a top view schematic illustration of a lighting device 1, according to the present invention.

The lighting device 1 shown in the present illustration includes eight possible locations for LED assemblies 101. Of these eight locations, two are covered with open covers 14 and two are covered with closed covers 15. The other four locations do not have any covers and the optic holder 11 is visible at these locations. At two locations there are LED assemblies 101 mounted on the printed circuit board 16.

Figure 17:
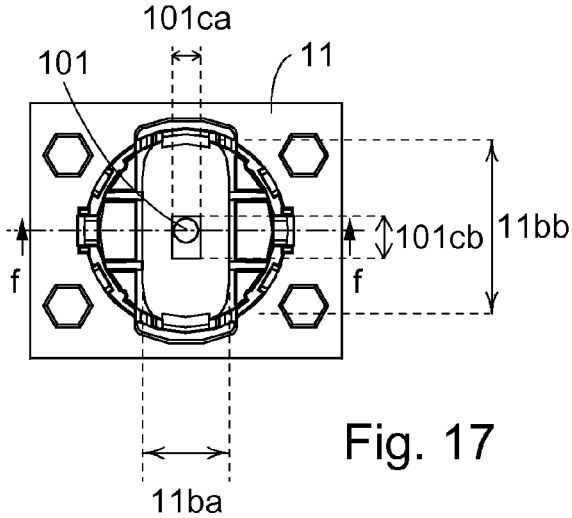
FIG. 17 is a top view schematic illustration of an optic holder and a LED assembly, according to the present invention, upon which section plane f-f is marked.

The present invention is very versatile with regard to many other possible combinations FIG. 17 is a top view schematic illustration of an optic holder 11 and a LED assembly 101, according to the present invention, upon which section plane f-f is marked.

In the present illustration, the optic holder 11 has only one location for a LED assembly 101 but other embodiments may have more locations.

The present illustration shows that the LED assembly 101 is located in the middle of the holder opening 11*b*. It is also possible to see that the opening longitudinal length 11*ba* and the opening lateral length 11*bb* are substantially larger than twice the LED package longitudinal length 101*ca* and the LED package lateral length 101*cb*, respectively. These size differences contribute to the minimization of risk to the LED dome 101*d*.

Figure 18:
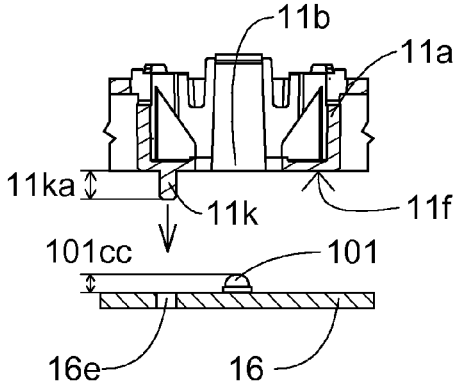
FIG. 18 is a cross sectional view f-f of an optic holder, a LED assembly and a printed circuit board, according to the present invention.

FIG. 18 is a cross sectional view f-f of an optic holder 11, a LED assembly 101, and a printed circuit board 16, according to the present invention.

This cross-section shows that the holder body 11*a* has a holder alignment pin 11*k* that only if the holder alignment pin 11*k* is inserted into the printed circuit alignment pin hole 16*e*, will the optic holder 11 be able to be mounted onto the printed circuit board 16. The locations of the holder alignment pin 11*k* and printed circuit alignment pin hole 16*e* are designed so that the LED assembly 101 would be located in the center of the holder opening 11*b*.

The holder alignment pin length 11*ka* is larger than the LED assembly height 101*cc*, to ensure no contact between the LED assembly 101 and the holder bottom surface 11*f* at any stage prior to insertion of the holder alignment pin 11*k* into the printed circuit alignment pin hole 16*e*.

Figure 19:
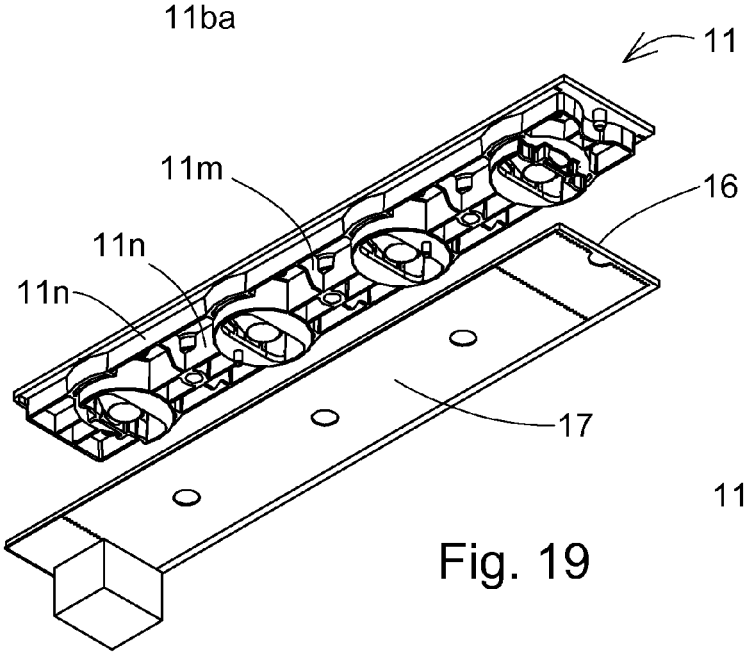
FIG. 19 is a left-bottom view isometric schematic illustration of an optic holder, a printed circuit board and a thermal pad, according to the present invention.

FIG. 19 is a left-bottom view isometric schematic illustration of an optic holder 11, a printed circuit board 16 and a thermal pad 17, according to the present invention.

In the underside of the optic holder 11 it is possible to see the holder longitudinal ribs 11*m* and holder lateral ribs 11.

This structure of the optic holder 11 ensures good fastening to the thermal pad 17.

Figure 20:
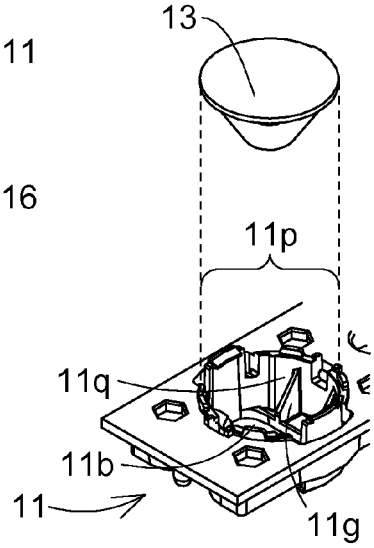
FIG. 20 is a top view isometric schematic illustration of a part of an optic holder and of an optic element, according to the present invention.

FIG. 20 is top view isometric schematic illustration of a part of an optic holder 11 and of an optic element 13, according to the present invention.

The present illustration depicts the way the optic element 13 is inserted into the optic holder 11. The optic element 13 is inserted into the holder space 11*p* which is designed to accommodate the optic element 13 and includes several holder optic guides 11*g* (normally, four or more) that while the optic element 13 is inserted into the holder space 11*p*, ensuring that the optic element 13 slides directly into its place without touching the LED dome 101*d* thereby possibly damaging it.

Furthermore, the holder optic guides 11*g* provide leverage to the optic element 13 after assembly.

The bottom of the holder space 11*p* is the holder opening 11*b* and the holder space walls 11*q* enclose the holder space 11*p*.

While the invention has been described with respect to a limited number of embodiments, it will be appreciated that many variations, modifications and other applications of the invention may be made.

What is claimed is:

1. A lighting device comprising:

(a) a main assembly including:

(i) at least one optic holder, wherein each one of said at least one optic holder includes:

(i.i) an holder body, having an holder upper surface and an holder bottom surface, wherein said bottom surface includes at least one holder opening; and (i.ii) at least one holder space wall disposed between said holder upper surface and said holder bottom surface, wherein said holder space wall contains an holder space, wherein each one of said at least one optic holder further includes:

(i.iii) at least one holder alignment pin disposed on said bottom surface, wherein said holder alignment pin has a predefined holder alignment pin length;

wherein each one of said at least one optic holder further includes:

(i.iv) at least one holder optic guide, disposed on each one of said holder space walls, inside each one of said at least one holder spaces, wherein each one of said at least one optic holder further includes:

(i.vi) at least one holder longitudinal rib disposed on said holder upper surface, and at least one holder lateral rib disposed on said holder upper surface.

2. The lighting device of claim 1, wherein each one of said at least one holder optic guide has an holder optic guide end, wherein there is a predefined holder optic guide end angle between said holder optic guide end and said holder bottom surface.

3. The lighting device of claim 2, wherein each one of said holder optic guide end angle has at least the value of forty five degrees.

4. A lighting device comprising:

(a) a main assembly including:

(i) at least one optic holder, wherein each one of said at least one optic holder includes:

(i.i) an holder body, having an holder upper surface and an holder bottom surface, wherein said bottom surface includes at least one holder opening; and (i.ii) at least one holder space wall disposed between said holder upper surface and said holder bottom surface, wherein said holder space wall contains an holder space, wherein each one of said at least one optic holder further includes:

(i.iii) at least one holder alignment pin disposed on said bottom surface, wherein said holder alignment pin has a predefined holder alignment pin length, wherein each one of said at least one optic holder further includes:

(i.iv) at least one holder optic guide, disposed on each one of said holder space walls inside each one of said at least one holder spaces, wherein each one of said at least one optic holder further includes:

(i.v) at least one holder rib disposed on said holder upper surface, wherein each one of said at least one holder openings has a predefined opening longitudinal length, and a predefined opening lateral length.

5. A lighting device comprising:

(a) a main assembly including:

(i) at least one optic holder, wherein each one of said at least one optic holder includes:

(i.i) an holder body, having an holder upper surface and an holder bottom surface, wherein said bottom surface includes at least one holder opening; and (i.ii) at least one holder space wall disposed between said holder upper surface and said holder bottom surface, wherein said holder space wall contains an holder space, wherein each one of said at least one optic holder further includes:

(i.iii) at least one holder alignment pin disposed on said bottom surface, wherein said holder alignment pin has a predefined holder alignment pin length, wherein each one of said at least one optic holder further includes:

(i.iv) at least one holder optic guide, disposed on each one of said holder space walls, inside each one of said at least one holder spaces, wherein each one of said at least one optic holder further includes:

(i.v) at least one holder rib disposed on said holder upper surface, wherein each one of said at least one holder optic guide has an holder optic guide end, wherein there is a predefined holder optic guide end angle between said holder optic guide end and said holder bottom surface.

6. The lighting device of claim 5, wherein each one of said holder optic guide end angle has at least the value of forty five degrees.

7. The lighting device of claim 5, wherein said main assembly further includes:

(vii) at least one optic element, mounted inside of each one of said holder openings, wherein said at least one optic element has an optic element hole, and wherein said at least one optic element has an optic element cone angle.

8. The lighting device of claim 7, wherein said optic element cone angle is compatible with said holder optic guide end angle.

9. A lighting device comprising:

(a) a main assembly including:

(i) at least one optic holder, wherein each one of said at least one optic holder includes:

(i.i) an holder body, having an holder upper surface and an holder bottom surface, wherein said bottom surface includes at least one holder opening; and (i.ii) at least one holder space wall disposed between said holder upper surface and said holder bottom surface, wherein said holder space wall contains an holder space, wherein each one of said at least one optic holder has a holder first end, and a holder second end, and wherein each one of said at least one optic holder further includes:

(i.vii) at least one holder screw hole formed through each one of said holder upper surfaces;

(i.viii) at least one holder pin hole, formed through each one of said holder upper surfaces;

(i.vix) an holder end pin located substantially close to said holder first end; and (i.x) a holder end hole located substantially close to said holder second end.

10. The lighting device of claim 9, wherein said main assembly further includes:

(viii) at least one main assembly screw mounted through one of said at least one holder screw hole.

11. A lighting device comprising:

(a) a main assembly including:

(i) at least one optic holder, wherein each one of said at least one optic holder includes:

(i.i) an holder body, having an holder upper surface and an holder bottom surface, wherein said bottom surface includes at least one holder opening; and (i.ii) at least one holder space wall disposed between said holder upper surface and said holder bottom surface, wherein said holder space wall contains an holder space, wherein each one of said at least one optic holder further includes:

(i.iii) at least one holder alignment pin disposed on said bottom surface, wherein said holder alignment pin has a predefined holder alignment pin length, wherein said main assembly further includes:

(ii) at least one printed circuit board, having a printed circuit board body, wherein said at least one printed circuit board, is securely connected to said at least optic holder, wherein each one of said at least one printed circuit board includes:

(ii.i) at least one header connector securely connected to said printed circuit board body.

12. The lighting device of claim 11, wherein said at least one printed circuit board, has at least one printed circuit board screw hole formed through each one of said printed circuit board body, and wherein said at least one printed circuit board, has at least one circuit boards connector formed through each one of said printed circuit board body.

13. The lighting device of claim 11, wherein said at least one printed circuit board, has at least one printed circuit board screw hole formed through each one of said printed circuit board body.

14. The lighting device of claim 11, wherein said at least one printed circuit board, has at least one printed circuit alignment pin hole formed through each one of said printed circuit board body.

15. The lighting device of claim 11, wherein said main assembly further includes:

(iii) at least one thermal pad having a thermal pad body wherein said at least one thermal pad is disposed on each one of said at least one printed circuit board.

16. The lighting device of claim 15, wherein said at least one printed circuit board has a thermal pad screw hole formed through each one of said printed circuit board body.

17. The lighting device of claim 11, wherein said main assembly further including:

(vi) at least one light emitted diode assembly having a light emitting diode assembly height, wherein said at least one light emitted diode assembly is securely connected to said at least one printed circuit board body, and wherein said at least one light emitted diode assembly includes:

(vi.i) a light emitted diode package having a light emitted diode package longitudinal length, and a light emitted diode package lateral length;

(vi.ii) a light emitted diode securely connected to said light emitted diode package; and (vi.iii) a light emitted diode dome light emitted diode package.

18. The lighting device of claim 17, wherein each one of said holder openings has a predefined opening longitudinal length, and a predefined opening lateral length, wherein said predefined opening longitudinal length is substantially larger than said light emitted diode package longitudinal length and wherein said predefined opening lateral length is substantially larger than said light emitted diode package lateral length.

19. The lighting device of claim 17, wherein each one of said holder openings has a predefined opening longitudinal length, and a predefined opening lateral length, wherein said predefined opening longitudinal length is substantially at least twice larger than said light emitted diode package longitudinal length and wherein said predefined opening lateral length is substantially at least twice larger than said light emitted diode package lateral length.

20. The lighting device of claim 17, wherein said at least one holder alignment pin length is substantially larger than said at least one of said light emitting diode package height.

21. A lighting device comprising:

(a) a main assembly including:

(i) at least one optic holder, wherein each one of said at least one optic holder includes:

(i.i) an holder body, having an holder upper surface and an holder bottom surface, wherein said bottom surface includes at least one holder opening; and (i.ii) at least one holder space wall disposed between said holder upper surface and said holder bottom surface, wherein said holder space wall contains an holder space, wherein said main assembly further includes:

(iv) at least one open cover, having an open cover weight value, mounted on said at least one optic holder, said at least one open cover includes:

(iv.i) an open cover body;

(iv.ii) a cover opening formed through said open cover body; and (iv.iii) at least one open cover pin disposed on said open cover body, wherein said holder body applies force on all of said at least one open cover pins, of one of said at least one open covers.

22. The lighting device of claim 21, wherein said force has at least the value of twice of said open cover weight value, and at most eight times of said open cover weight value.

23. The lighting device of claim 21 wherein said at least one open covers further includes:

(iv.iv) at least open cover leg disposed on said open cover body.

24. The lighting device of claim 21, wherein said main assembly further including:

(v) at least one closed cover mounted on said at least one optic holder, said at least one open covers includes:

(v.i) a closed cover body;

(v.ii) at least one closed cover leg disposed on said closed cover body; and (v.iii) at least one closed cover pin disposed on said open cover body, wherein said holder body applied forces on all of said at least one closed cover pins, of one of said at least one closed covers, wherein said forces has at least the value of twice said open cover weight value, and of at most eight times said open cover weight value.

25. A lighting device comprising:

(a) a main assembly including:

(i) at least one optic holder, wherein each one of said at least one optic holder includes:

(i.i) an holder body, having an holder upper surface and an holder bottom surface, wherein said bottom surface includes at least one holder opening; and (i.ii) at least one holder space wall disposed between said holder upper surface and said holder bottom surface, wherein said holder space wall contains an holder space, wherein said main assembly further includes:

(ii) at least one printed circuit board, having a printed circuit board body, wherein said at least one printed circuit board, is securely connected to said at least optic holder, wherein each one of said at least one printed circuit board includes:

(ii.i) at least one header connector securely connected to said printed circuit board body;

(iii) at least one thermal pad having a thermal pad body wherein said at least one thermal pad is disposed on each one of said at least one printed circuit board;

(iv) at least one open covers, having an open cover weight value, mounted on said at least one optic holder, said at least one open cover including:

(iv.i) an open cover body;

(iv.ii) a cover opening formed through said open cover body; and (iv.iii) at least one open cover pin disposed on said open cover body, wherein said holder body applied forces on all of said at least one open cover pins, of one of said at least one open covers;

(v) at least one light emitted diode assembly having a light emitting diode assembly height, wherein said at least one light emitted diode assembly is securely connected to said at least one printed circuit board body, and wherein said at least one light emitted diode assembly includes:

(v.i) a light emitted diode package having a light emitted diode package longitudinal length, and a light emitted diode package lateral length;

(v.ii) a light emitted diode securely connected to said light emitted diode package; and (v.iii) a light emitted diode dome light emitted diode package;

(vi) at least one optic element, mounted inside of each one of said holder opening, wherein said at least one optic element has an optic element hole, and wherein said at least one optic element has an optic element cone angle; and (vii) at least one main assembly screw mounted through said holder body.

26. A lighting device comprising:

(a) a main assembly including:

(i) at least one optic holder, wherein each one of said at least one optic holder includes:

(i.i) an holder body, having an holder upper surface and an holder bottom surface, wherein said bottom surface includes at least one holder opening; and (i.ii) at least one holder space wall disposed between said holder upper surface and said holder bottom surface, wherein said holder space wall contains an holder space; and (b) a housing, wherein said main assembly is located inside said housing, and wherein said housing includes:

(i) a housing body.

27. The lighting device of claim 26, wherein said housing further includes:

(ii) an exterior cover mounted on said housing, wherein said exterior cover is at least partially transparent to light.

28. The lighting device f claim 27, wherein said main assembly further includes:

(ii) at least one main assembly screw mounted through said holder body.

29. The lighting device of claim 28, wherein said housing further includes:

(iii) at least one screws holder mounted inside said housing, wherein said at least one main assembly screw is screwed into said at least one screws holder.

30. A lighting device comprising:

(a) a main assembly including:

(i) at least one optic holder, wherein each one of said at least one optic holder includes:

(i.i) an holder body, having an holder upper surface and an holder bottom surface, wherein said bottom surface includes at least one holder opening;

(i.ii) at least one holder space wall disposed between said holder upper surface and said holder bottom surface, wherein said holder space wall contain an holder space;

(i.iii) at least one holder alignment pin disposed on said bottom surface, wherein said holder alignment pin has a predefined holder alignment pin length;

(i.iv) at least one holder optic guide, disposed on each one of said holder space walls, inside each one of said at least one holder spaces;

(i.v) at least one holder rib disposed on said holder upper surface;

(i.vi) at least one holder longitudinal rib disposed on said holder upper surface, and at least one holder lateral rib disposed on said holder upper surface;

(i.vii) at least one holder screw hole formed through each one of said holder upper surfaces; and (i.viii) at least one holder pin hole, formed through each one of said holder upper surfaces, wherein each one of said at least one holder openings has a predefined opening longitudinal length, and a predefined opening lateral length, wherein each one of said at least one holder optic guide has an holder optic guide end, wherein there is a predefined holder optic guide end angle between said holder optic guide end and said holder bottom surface;

(ii) at least one printed circuit board, having a printed circuit board body, wherein said at least one printed circuit board, is securely connected to said at least optic holder, wherein each one of said at least one printed circuit board includes:

(ii.i) at least one header connector securely connected to said printed circuit board body, wherein said at least one printed circuit board, has at least one printed circuit alignment pin hole formed through each one of said printed circuit board body;

(iii) at least one thermal pad having a thermal pad body wherein said at least one thermal pad is disposed on each one of said at least one printed circuit board;

(iv) at least one open covers, having an open cover weight value, mounted on said at least one optic holder, said at least one open covers includes:

(iv.i) an open cover body;

(iv.ii) a cover opening formed through said open cover body; and (iv.iii) at least one open cover pin disposed on said open cover body, wherein said holder body applied forces on all of said at least one open cover pins, of one of said at least one open covers;

(v) at least one light emitted diode assembly having a light emitting diode assembly height, wherein said at least one light emitted diode assembly is securely connected to said at least one printed circuit board body, and wherein said at least one light emitted diode assembly includes:

(v.i) a light emitted diode package having a light emitted diode package longitudinal length, and a light emitted diode package lateral length;

(v.ii) a light emitted diode securely connected to said light emitted diode package; and (v.iii) a light emitted diode dome light emitted diode package, wherein each one of said holder openings has a predefined opening longitudinal length, and a predefined opening lateral length, wherein said predefined opening longitudinal length is substantially larger than said light emitted diode package longitudinal length and wherein said predefined opening lateral length is substantially larger than said light emitted diode package lateral length, wherein said at least one holder alignment pin length is substantially larger than said at least one of said light emitting diode package height;

(vii) at least one optic element, mounted inside of each one of said holder opening, wherein said at least one optic element has an optic element hole, and wherein said at least one optic element has an optic element cone angle, wherein said optic element cone angle is compatible with said holder optic guide end angle; and (viii) at least one main assembly screw mounted through one of said at least one holder screw hole.

31. The lighting device of claim 30 further comprising:

(b) a housing, wherein said main assembly is located inside said housing, and wherein said housing includes:

(i) a housing body.

32. The lighting device of claim 31, wherein said housing further includes:

(ii) an exterior cover mounted on said housing, wherein said exterior cover is at least partially transparent to light.

33. The lighting device of claim 32, wherein said housing further includes:

(iii) at least one screws holder mounted inside said housing, wherein said at least one main assembly screw is screwed into said at least one screws holder.

* * * * *